US012467641B2

(12) United States Patent
Lu et al.

(10) Patent No.: US 12,467,641 B2
(45) Date of Patent: Nov. 11, 2025

(54) PORTABLE AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventors: Shaozhang Lu, Guangdong (CN); Eli Zhao, Guangdong (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 331 days.

(21) Appl. No.: 18/098,338

(22) Filed: Jan. 18, 2023

(65) Prior Publication Data

US 2023/0151977 A1 May 18, 2023

Related U.S. Application Data

(63) Continuation of application No. PCT/CN2021/088352, filed on Apr. 20, 2021.

(30) Foreign Application Priority Data

Jul. 27, 2020 (CN) ..... 202010734600.6
Jul. 27, 2020 (CN) ..... 202011202533.X
Jul. 27, 2020 (CN) ..... 202021514119.8

(51) Int. Cl.
*F24F 1/04* (2011.01)
*F24F 1/028* (2019.01)
(Continued)

(52) U.S. Cl.
CPC ..... *F24F 1/04* (2013.01); *F24F 1/028* (2019.02); *F24F 1/0323* (2019.02); *F24F 1/035* (2019.02)

(58) Field of Classification Search
CPC .. F24F 1/04; F24F 1/028; F24F 1/0323; F24F 1/035; F24F 1/022; F24F 13/20
See application file for complete search history.

(56) References Cited

U.S. PATENT DOCUMENTS

2018/0326812 A1* 11/2018 Ko ..... B60H 1/00685

FOREIGN PATENT DOCUMENTS

CN 102313338 A 1/2012
CN 102466281 A 5/2012
(Continued)

OTHER PUBLICATIONS

Machine translation CN106678971 (Year: 2017).*
(Continued)

*Primary Examiner* — Joseph F Trpisovsky
(74) *Attorney, Agent, or Firm* — Scully, Scott, Murphy & Presser, P.C.

(57) ABSTRACT

A portable air conditioner is provided. The portable air conditioner has a cabinet and an air outlet housing. The cabinet has an upper housing and a lower housing. The lower housing projects rearwardly relative to the upper housing. The upper housing is provided with a first air inlet, and the lower housing is provided with a second air inlet. The air outlet housing is mounted in the cabinet. An inlet of the air outlet housing is provided with a heat exchanger. The first air inlet is communicated with the heat exchanger to form a first air intake channel. The second air inlet is communicated with the heat exchanger to form a second air intake channel.

10 Claims, 16 Drawing Sheets

(51) Int. Cl.
*F24F 1/0323* (2019.01)
*F24F 1/035* (2019.01)

(56) References Cited

FOREIGN PATENT DOCUMENTS

| | | | | | |
|---|---|---|---|---|---|
| CN | 104613550 | A | | 5/2015 | |
| CN | 204902022 | U | | 12/2015 | |
| CN | 106678971 | A | * | 5/2017 | ..... F24F 1/0014 |
| CN | 106976543 | A | | 7/2017 | |
| CN | 108302671 | A | | 7/2018 | |
| CN | 108332304 | A | | 7/2018 | |
| CN | 108613268 | A | | 10/2018 | |
| CN | 108758859 | A | | 11/2018 | |
| CN | 208186613 | U | | 12/2018 | |
| CN | 109681967 | A | | 4/2019 | |
| CN | 111735116 | A | | 10/2020 | |
| CN | 212299204 | U | | 1/2021 | |
| CN | 112325390 | A | | 2/2021 | |
| CN | 215175534 | U | | 12/2021 | |
| JP | 3957728 | B1 | | 8/2007 | |
| KR | 20190106560 | A | | 9/2019 | |
| KR | 20190129374 | A | | 11/2019 | |
| WO | 2005116530 | A1 | | 12/2005 | |

OTHER PUBLICATIONS

First Office Action dated Jun. 25, 2024 received in Chinese Patent Application No. CN 202010734600.6.

International Search Report dated Jul. 12, 2021 issued in PCT/CN2021/088352.

Written Opinion dated Jul. 12, 2021 issued in PCT/CN2021/088352.

Chinese First Office Action dated Jun. 25, 2021 issued in 202011202533.X.

Chinese Second Office Action dated Jan. 17, 2022 issued in 202011202533.X.

* cited by examiner

PORTABLE AIR CONDITIONER

CROSS-REFERENCE TO RELATED APPLICATIONS

This application is a continuation of International Application No. PCT/CN2021/088352, filed on Apr. 20, 2021, which claims priorities to and benefits of Chinese Application No. 202010734600.6, filed on Jul. 27, 2020 and entitled "PORTABLE AIR CONDITIONER", and Chinese Application No. 202021514119.8, filed on Jul. 27, 2020 and entitled "PORTABLE AIR CONDITIONER", and Chinese Application No. 202011202533.X, filed on Jul. 27, 2020 and entitled "PORTABLE AIR CONDITIONER", the entire contents of each of which are incorporated herein by reference.

TECHNICAL FIELD

The present disclosure relates to the technical field of air conditioning equipment, and in particular, to a portable air conditioner.

BACKGROUND

In the related art, an air duct is generally installed to a rear end on a cabinet of a portable air conditioner. When the portable air conditioner is running, the installed air duct may obstruct an air inlet of the rear end on the cabinet, and thus has an influence on an air intake volume entering an air outlet housing. Especially, when the portable air conditioner is installed against a wall, an air resistance of the air inlet becomes significantly large, and the air intake volume will be affected, so that the heat exchange capability and the actual heat exchange effect of the portable air conditioner are decreased.

SUMMARY

The present disclosure aims at solving at least one of the technical problems in the prior art. Therefore, the present disclosure provides a portable air conditioner, which adopts a second air inlet connected to a heat exchanger on a cabinet to supplement air supply, thereby improving a heat exchange capacity and a heat exchange effect of the portable air conditioner.

On one hand, a portable air conditioner according to certain exemplary embodiments of the present disclosure includes a cabinet and an air outlet housing provided in the cabinet. A rear end of the cabinet is provided with a back plate. The back plate is provided with a first air inlet. The rear end of the cabinet protrudes relative to the back plate to form a rear housing. The rear housing is provided with a vent hole, and an air duct communicated with the vent hole is formed inside the rear housing. The air outlet housing is provided with an air intake hole. A heat exchanger is provided at the air intake hole. The air intake hole is in an opposite position to and communicated with the first air inlet. The vent hole is communicated with the air intake hole through the air duct.

The portable air conditioner according to certain exemplary embodiments of the present disclosure offers at least the following beneficial effects.

By adding the vent hole in the rear housing of the cabinet, and forming the air duct communicated with the vent hole in the rear housing, the air entering the vent hole is guided to the air intake hole of the air outlet housing through the air duct. Thus, air is supplemented into the first air inlet on the back plate of the cabinet. As a result, a heat exchange volume of the heat exchanger is increased, a heat exchange effect of the portable air conditioner is improved, and an air output volume of the air outlet housing is increased.

According to some embodiments of the present disclosure, the vent hole is provided on at least one wall surface of the rear housing in a left-right direction.

According to some embodiments of the present disclosure, a plurality of vent holes are provided, and the plurality of vent holes are distributed on at least one of a rear wall surface and an upper wall surface of the rear housing.

According to some embodiments of the present disclosure, a dimension of the vent hole in a width direction is d, and d meets the conditions that: $d \geq 20$ mm, or $0 < d \leq 8$ mm.

According to some embodiments of the present disclosure, the portable air conditioner further includes an air duct. The air duct is mounted at an upper end of the rear housing, and the vent holes are arranged at an interval along a periphery of the air duct.

According to some embodiments of the present disclosure, the portable air conditioner further includes a middle plate. The middle plate is arranged in the cabinet, and the air duct is formed between the middle plate and the rear housing.

According to some embodiments of the present disclosure, the portable air conditioner further includes an air deflector located in the rear housing. The air deflector is respectively connected to the middle plate and the air duct in either end, an outer wall of the air deflector is in a streamlined shape, and the air duct is formed among the air deflector, the middle plate and the rear housing.

According to some embodiments of the present disclosure, the first air inlet is detachably connected to a first filter assembly, and the first filter assembly is used for filtering air entering the first air inlet.

According to some embodiments of the present disclosure, a second air inlet located in the air duct is formed in the cabinet, the second air inlet is located below the first air inlet, and the second air inlet is connected to a second filter assembly, and the second filter assembly is used for filtering air entering the vent hole.

According to some embodiments of the present disclosure, the second filter assembly and the first filter assembly are in a fixed connection.

According to some embodiments of the present disclosure, a positioning frame is arranged in the cabinet, the positioning frame is located at the second air inlet, and the positioning frame is provided with a positioning groove matched with the second filter assembly.

On the other hand, a portable air conditioner according to certain exemplary embodiments of the present disclosure includes a cabinet and an air outlet housing mounted in the cabinet. The cabinet includes an upper housing and a lower housing. The upper housing is provided with a first air inlet. The lower housing is arranged in a backwardly protruding way relative to the upper housing, and the lower housing is provided with a second air inlet. A heat exchanger is mounted on the air outlet housing at an air intake side. The first air inlet is communicated with the heat exchanger and forms a first air intake channel. The second air inlet is communicated with the heat exchanger and forms a second air intake channel.

The portable air conditioner according to certain exemplary embodiments of the present disclosure offers at least the following beneficial effects.

By adding the second air inlet in the lower housing of the cabinet, and forming the second air intake channel communicated with the second air inlet in the cabinet, the air entering the second air inlet is guided into the heat exchanger to supplement air to the first air inlet of the cabinet. Thus, a heat exchange air volume of the heat exchanger is increased, a heat exchange effect of the portable air conditioner is improved, and an air output volume of the air outlet housing is increased.

According to some embodiments of the present disclosure, the second air inlet is located on the top wall, the top wall is provided with a mounting part for fixing an air duct, and the second air inlet is arranged along a periphery of the mounting part.

According to some embodiments of the present disclosure, the second air inlet includes a plurality of through holes in a uniform arrangement.

According to some embodiments of the present disclosure, the second air inlet is located on the top wall, and arranged along a periphery of the mounting part.

According to some embodiments of the present disclosure, a diameter of a largest inscribed circle inside the second air inlet is d, and d meets the conditions that: $0<d\leq 8$ mm.

According to some embodiments of the present disclosure, the portable air conditioner further includes a middle plate. The middle plate is arranged in the cabinet, the second air intake channel is formed between the middle plate and the lower housing, and the second air inlet is located above the middle plate.

According to some embodiments of the present disclosure, the portable air conditioner further includes an air deflector located in the lower housing. An upper part of the lower housing is provided with a mounting part used for fixing an air duct, the air deflector is respectively connected to the middle plate and the mounting part in either end, and the second air intake channel is formed among the air deflector, the middle plate and the lower housing.

According to some embodiments of the present disclosure, the first air inlet is detachably connected to a first filter assembly, and the first filter assembly is used for filtering air entering the first air inlet.

According to some embodiments of the present disclosure, the lower housing is provided with a second filter assembly inside, and the second filter assembly is located at the second air intake channel for filtering air entering the second air inlet.

According to some embodiments of the present disclosure, the second filter assembly and the first filter assembly are formed in an integrated piece.

Additional features and advantages of the present disclosure will be set forth in the description which follows, and in part will be obvious from the description, or may be learned by the practice of the present disclosure.

Additional features and advantages of the present disclosure will be set forth in the description which follows, and in part will be obvious from the description, or may be learned by the practice of the present disclosure.

BRIEF DESCRIPTION OF DRAWINGS

The above and/or additional aspects and advantages of the present disclosure will be more apparent from the following description of certain exemplary embodiments in conjunction with the accompanying drawings, where.

Figure 1:
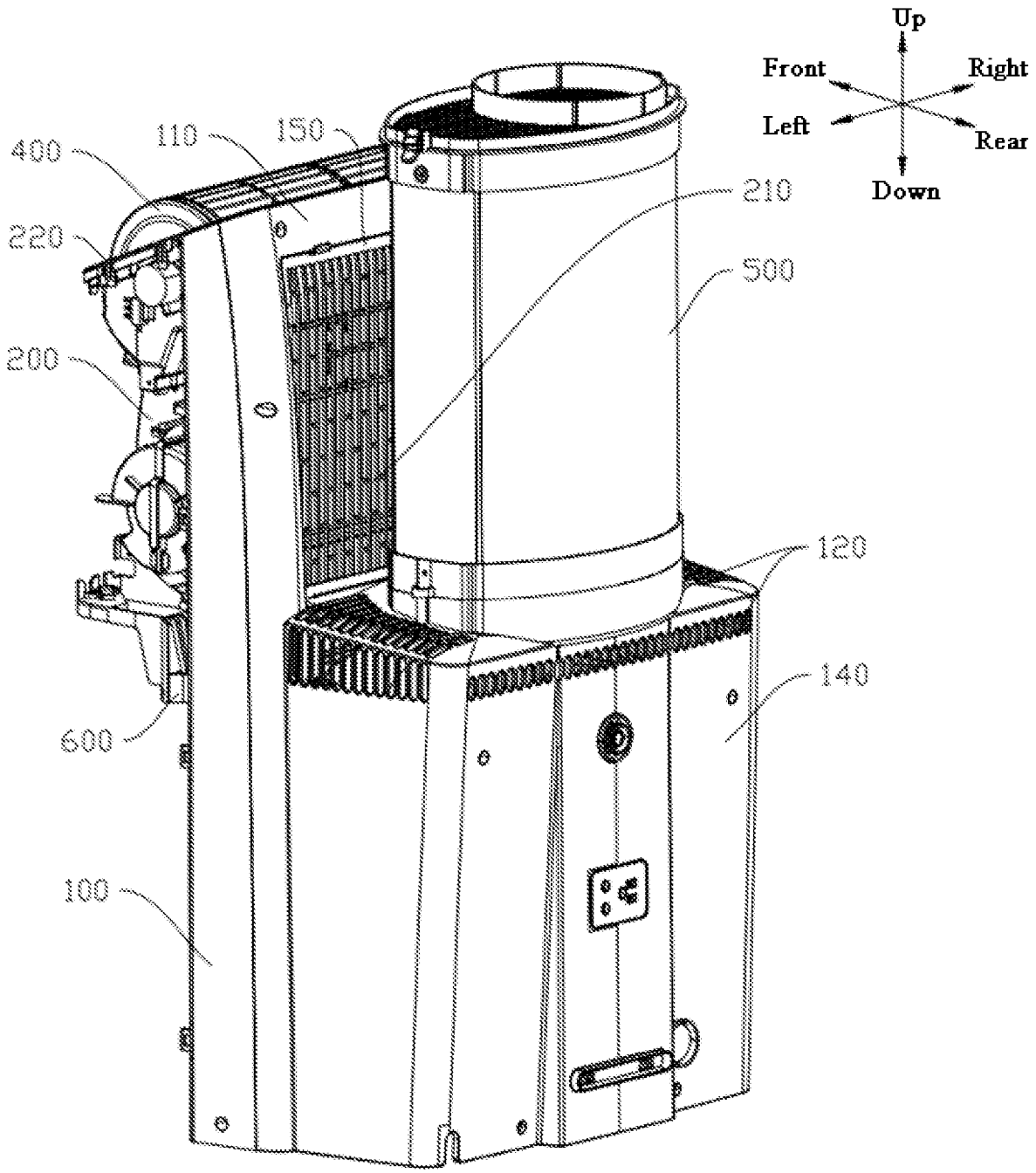
FIG. 1 is a schematic diagram of a portable air conditioner according to one embodiment of the present disclosure.

Reference numerals shown in the figures are described as follows:

| | | | | | |
|---|---|---|---|---|---|
| 100 | cabinet; | 110 | back plate; | 110' | upper housing; |
| 111 | first air inlet; | 120 | vent hole; | 120' | lower housing; |
| 121 | second air inlet; | 122 | mounting part; | 130 | air duct; |
| 130' | top wall; | 140 | rear housing; | 140' | surrounding wall; |
| 150 | first filter assembly; | 151 | buckle; | 152 | mounting frame; |
| 153 | grid; | 160 | second air inlet; | | |
| 160', 170 | second filter assembly; | | | | |
| 200 | air outlet housing; | 210 | air intake hole; | 220 | air outlet hole; |
| 300 | heat exchanger; | | | | |
| 400 | air supply mechanism; | | | | |
| 500 | air duct; | | | | |
| 600 | middle plate; | 610 | positioning frame; | 611 | guide part; |
| 612 | positioning groove; and | | | | |
| 700 | air deflector. | | | | |

DETAILED DESCRIPTION

Certain exemplary embodiments of the disclosure will be described in detail hereinafter. Examples of the embodiments are shown in the accompanying drawings. The same or similar reference numerals throughout the drawings represent the same or similar elements or elements having the same or similar functions. The exemplary embodiments described below with reference to the accompanying drawings are exemplary and are only intended to explain the present disclosure, but should not be understood as limitation on the present disclosure.

In the description of the present disclosure, it should be understood that the orientation or positional relationship indicated by the terms relating orientation description such as "upper", "lower", "right" and the like is based on the orientation or positional relationship shown in the drawings, only for the convenience of describing and simplifying the present disclosure, and does not indicate or imply that the indicated device or element must have a specific orientation, or be constructed and operated in a specific orientation. Therefore, the terms should not be construed as limiting the present disclosure.

In the description of the present disclosure, the term of "first" and "second" are used for the purpose of distinguishing the technical features only, and should not be understood as indicating or implying relative importance, or implicitly indicating the number of technical features indicated thereby, or implicitly indicating the order of technical features indicated thereby.

In the description of the present disclosure, unless otherwise explicitly defined, words such as "setting/set", "installing/installed" and "connecting/connected" should be understood in a broad sense, and those skilled in the art can reasonably determine the specific meanings of the above words in the present disclosure in combination with the specific contents of the technical solutions.

Figure 4:
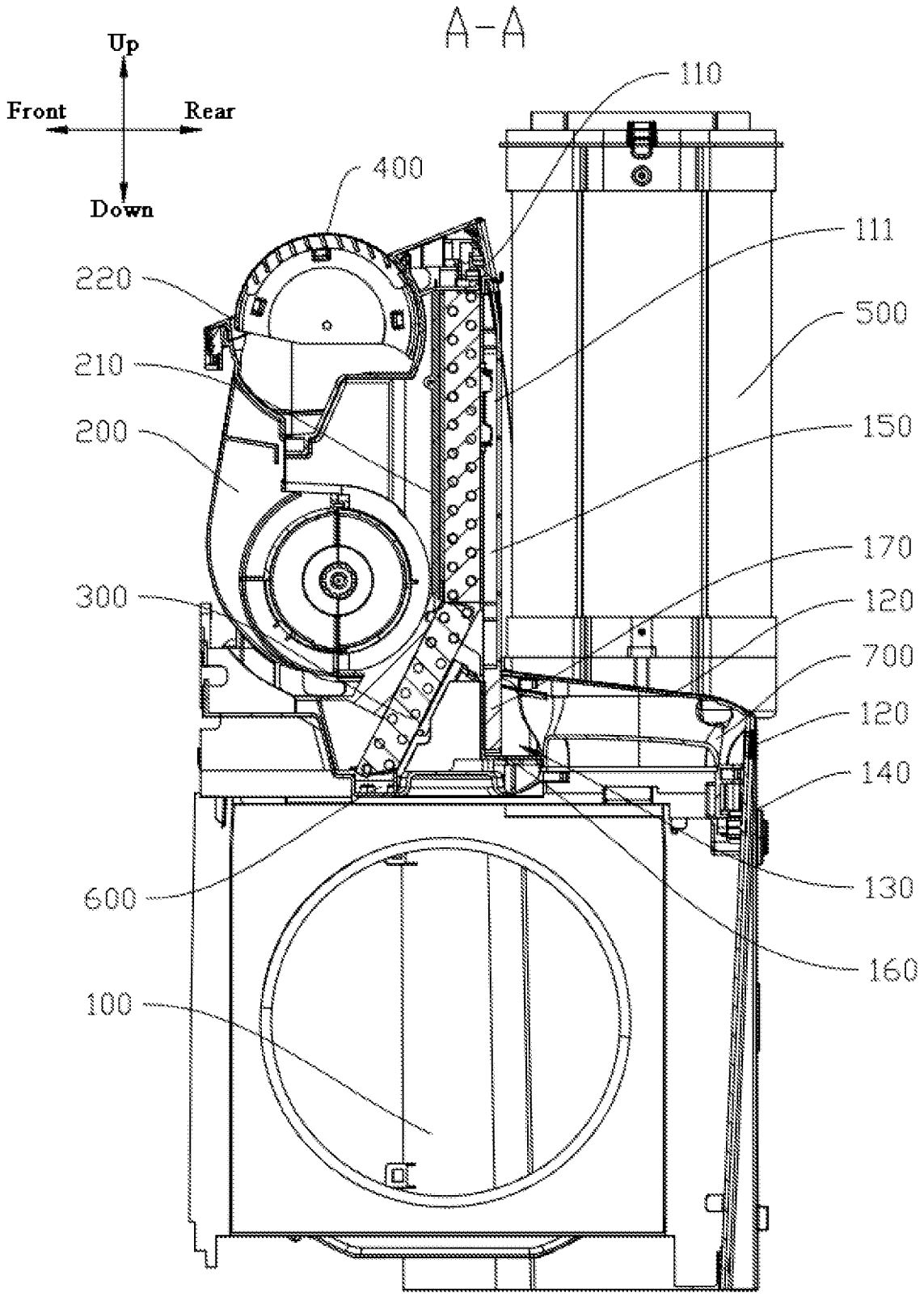
FIG. 4 is a sectional view from a section A-A in FIG. 3.
Figure 8:
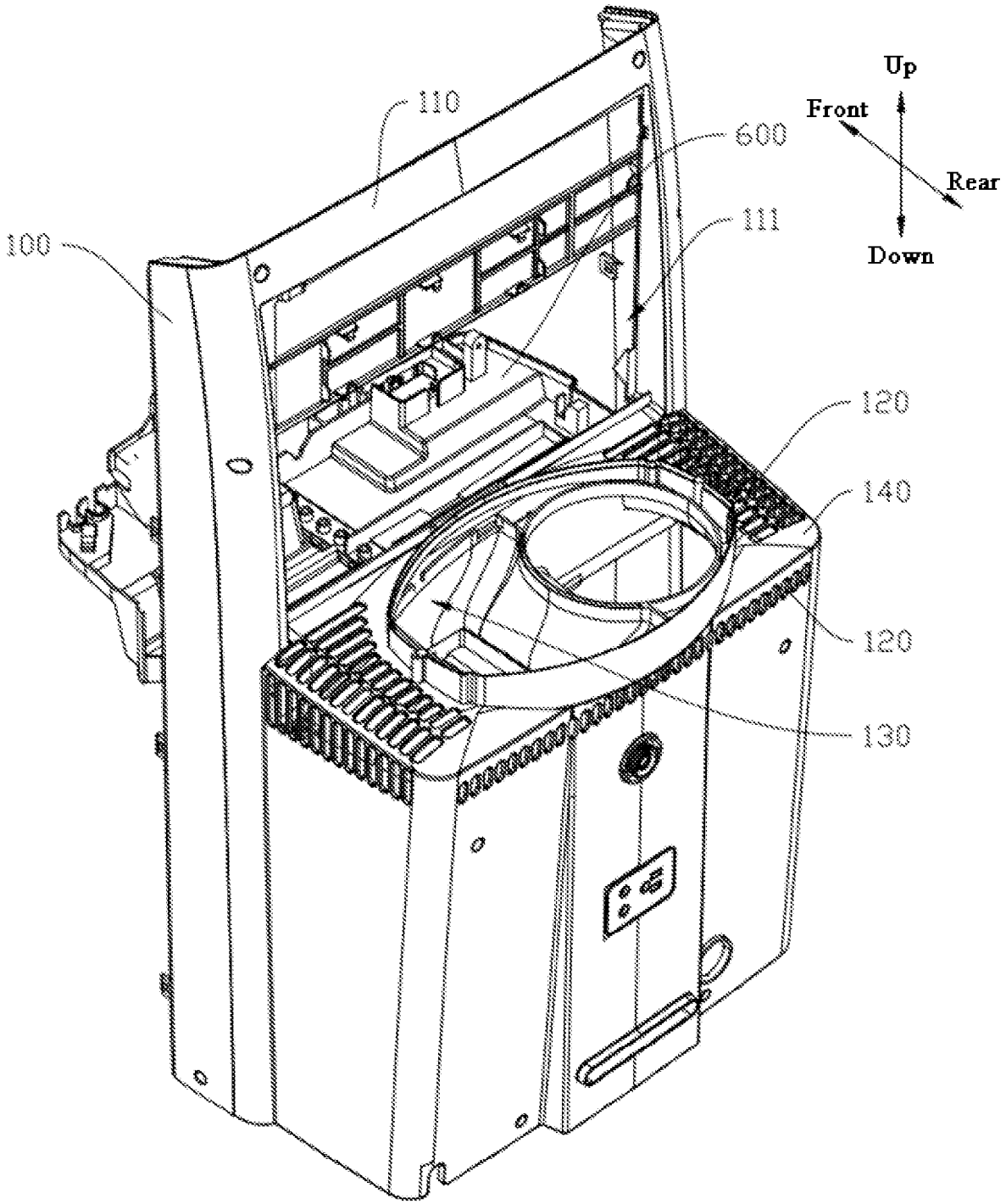
FIG. 8 is a schematic structural diagram of a cabinet and a middle plate of a portable air conditioner according to one embodiment of the present disclosure.

Referring to FIG. 1 and FIG. 4, a portable air conditioner according to one embodiment of the present disclosure includes a cabinet 100 and an air outlet housing 200. The air outlet housing 200 is mounted in the cabinet 100, and the air outlet housing 200 is provided with an air intake hole 210 and an air outlet hole 220. A heat exchanger 300 is mounted at the air intake hole 210, and the air outlet housing 200 is mounted with an air supply mechanism 400 at the air outlet hole 220. Referring to FIG. 8, a rear end of the cabinet 100 is provided with a back plate 110, and the back plate 110 is provided with a first air inlet 111. The first air inlet 111 is in an opposite position to and communicated with the air intake hole 210. The first air inlet 111 is communicated with an external environment. The first air inlet 111 is a main air inlet of the portable air conditioner, and is used for air in the external environment to enter the heat exchanger 300 for heat exchange. When the portable air conditioner is running for refrigeration, a wind wheel in the air outlet housing 200 rotates, driving the air to enter the cabinet 100 from the first air inlet 111, and exchanging heat through the heat exchanger 300. The air after heat exchange is blown out from the air supply mechanism 400 under the guidance of the wind wheel to adjust a temperature of the external environment.

Figure 2:
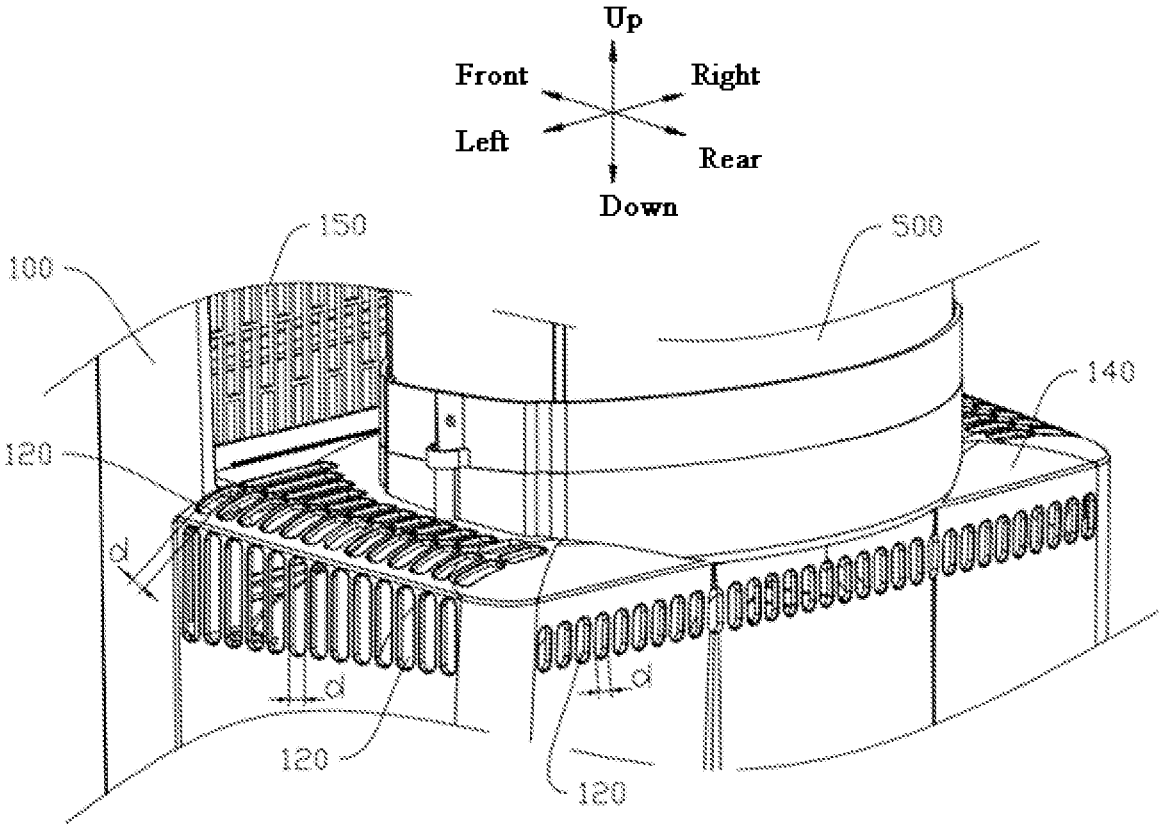
FIG. 2 is a partial enlarged view of FIG. 1.
Figure 3:
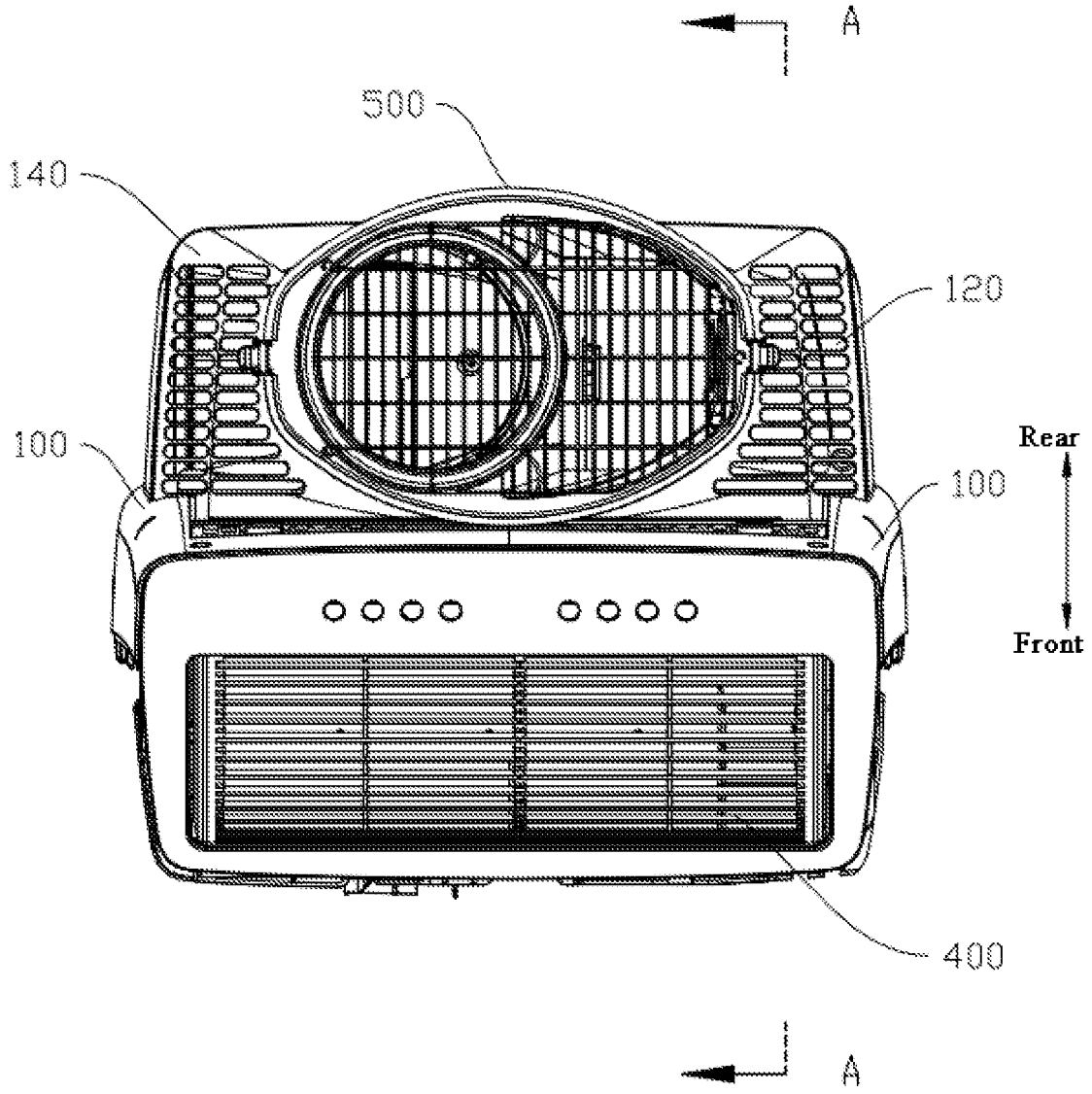
FIG. 3 is a top view of FIG. 1.

Referring to FIG. 1 and FIG. 2, a portable air conditioner according to one embodiment of the present disclosure has a cabinet 100 provided with a rear housing 140, the rear housing 140 is formed by a rear end of the cabinet 100 protruding relative to a back plate 110, and the rear housing 140 and the first air inlet 111 are separated from each other in an up-down direction. The rear housing 140 is provided with a vent hole 120, the vent hole 120 may be provided in one or more elongated structures, and the elongated structures may be extended in a horizontal direction or in a vertical direction, which is not specifically limited here. In addition, a plurality of vent holes 120 may be provided, and the plurality of vent holes 120 are combined to form a grid structure, and are not specifically limited here. Referring to FIG. 3 and FIG. 4, an air duct 130 communicated with the vent hole 120 is formed in the cabinet 100, and the air duct 130 is connected to the vent hole 120 and the air intake hole 210 respectively in either end, so that an air volume supplemented by the vent hole 120 is guided into the air outlet housing 200, thereby enhancing a heat exchange efficiency of the heat exchanger 300, improving a heat exchange effect of the portable air conditioner, increasing an air output volume of the air supply mechanism 400, and improving user experience. Moreover, when the portable air conditioner is mounted against a wall, because the first air inlet 111 is blocked by a wall surface or an air duct 500 located behind the back plate 110, an effective air intake area is smaller and an air inlet volume is decreased. In this case, the vent hole 120 can play a role in supplementing an air volume, and improving a capacity and actual cooling and heating effects of the portable air conditioner.

In some embodiments of the present disclosure, the air duct 130 is defined between internal structures of the cabinet 100, and the air duct 130 may be arranged in such a way that each vent hole 120 is independently provided with one air duct 130, or the plurality of vent holes 120 share one air duct 130.

Figure 5:
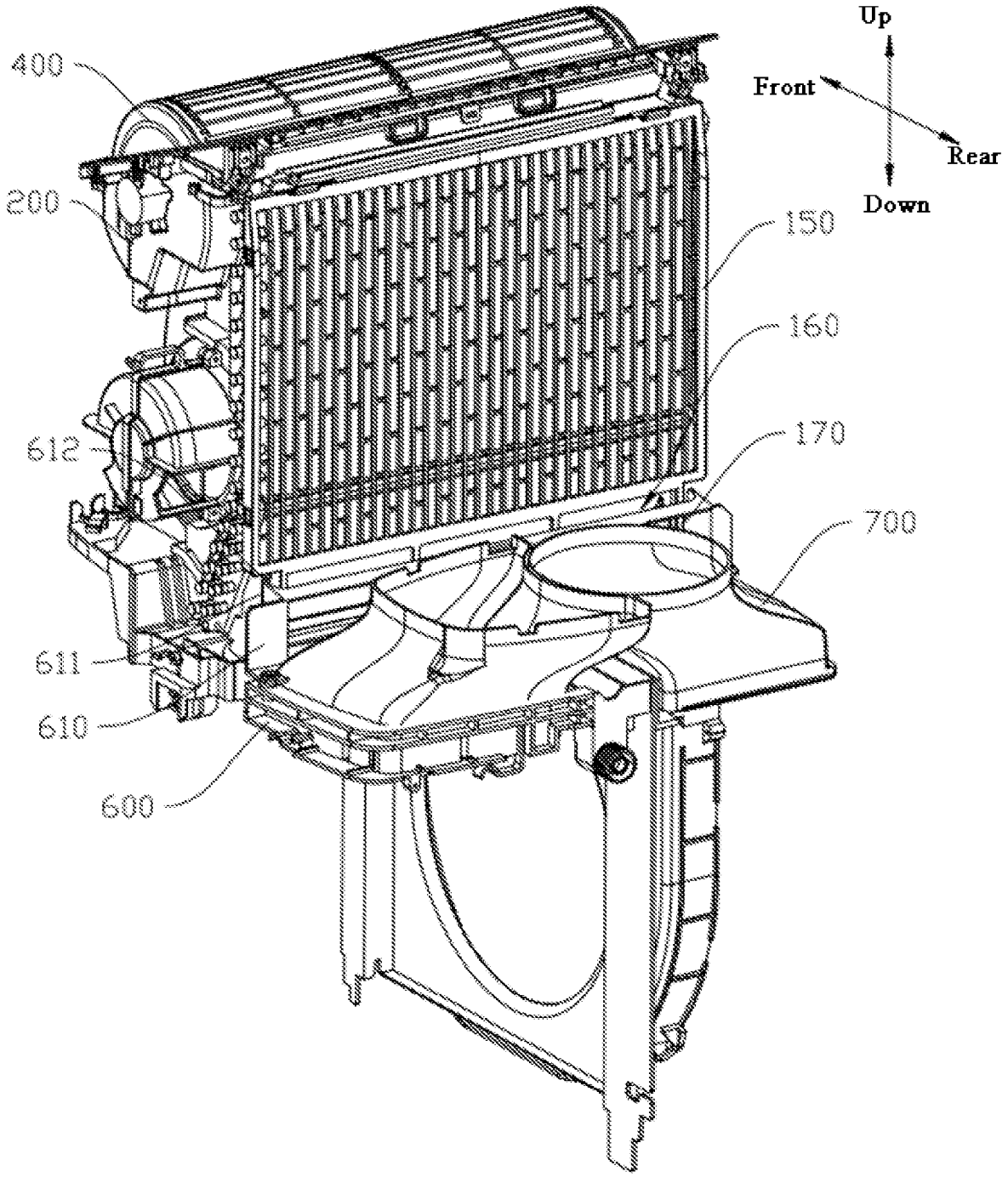
FIG. 5 is a schematic diagram of a portable air conditioner according to one embodiment of the present disclosure, with a cabinet and an air duct disassembled.

Referring to FIG. 4 and FIG. 5, in some embodiments of the present disclosure, the portable air conditioner further includes a middle plate 600. The middle plate 600 is arranged in the cabinet 100, and a cavity for containing the air outlet housing 200 is formed between the middle plate 600 and the cabinet 100. The air outlet housing 200 is mounted on the middle plate 600, and a sealed cavity is formed between the middle plate 600 and the rear housing 140. The cavity defines an air duct 130 communicated with the vent hole 120 and the air intake hole 210, so that the air duct 130 has a satisfactory sealing performance; and an air intake flow of the air intake hole 120 can be prevented from diffusion in the cabinet 100, preventing a loss of air volume of the intake air. In addition, the vent hole 120 introduces the supplemented air intake flow into the air outlet housing 200 through the sealed air duct 130, thereby improving the heat exchange efficiency of the portable air conditioner.

Figure 6:
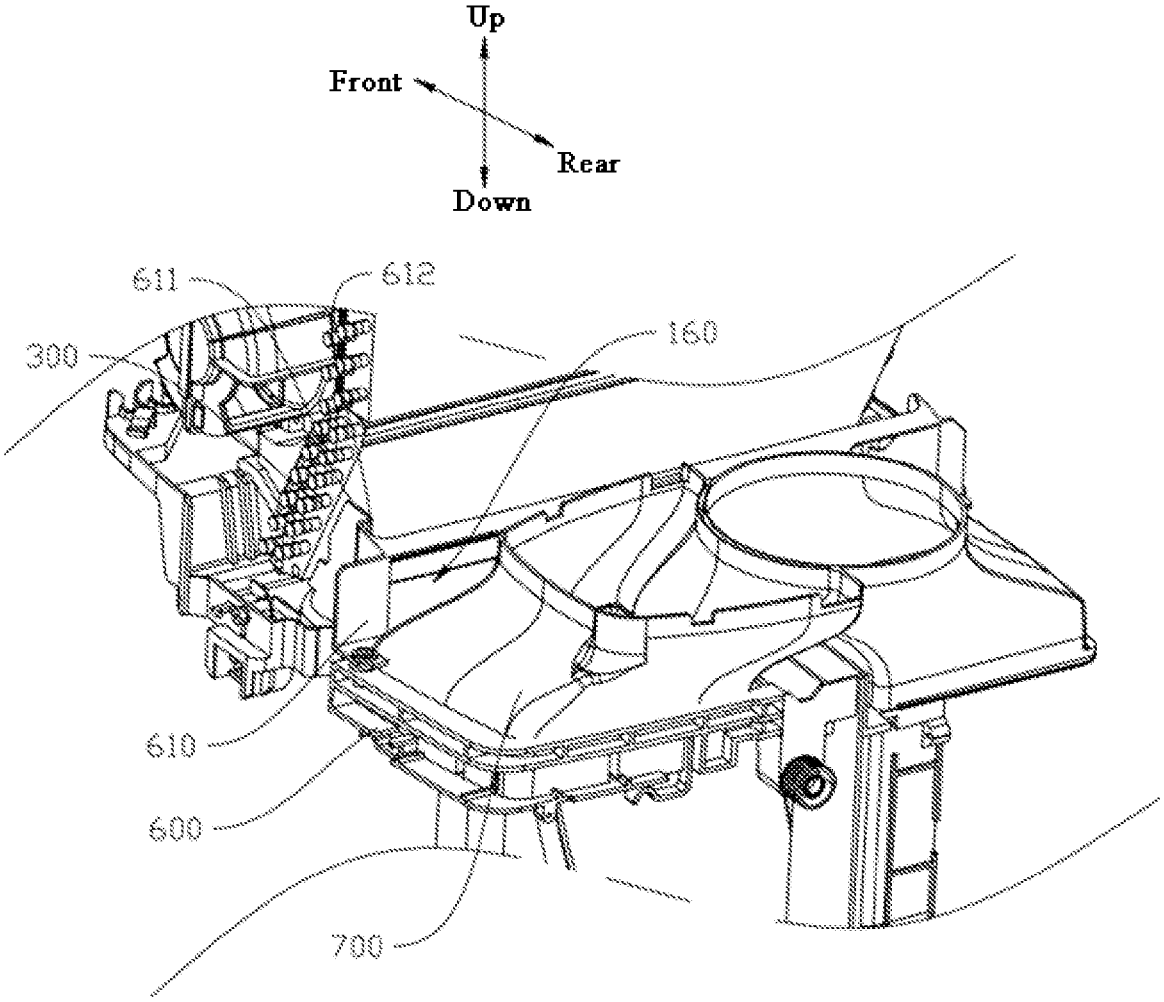
FIG. 6 is a partial enlarged view of FIG. 5.
Figure 9:
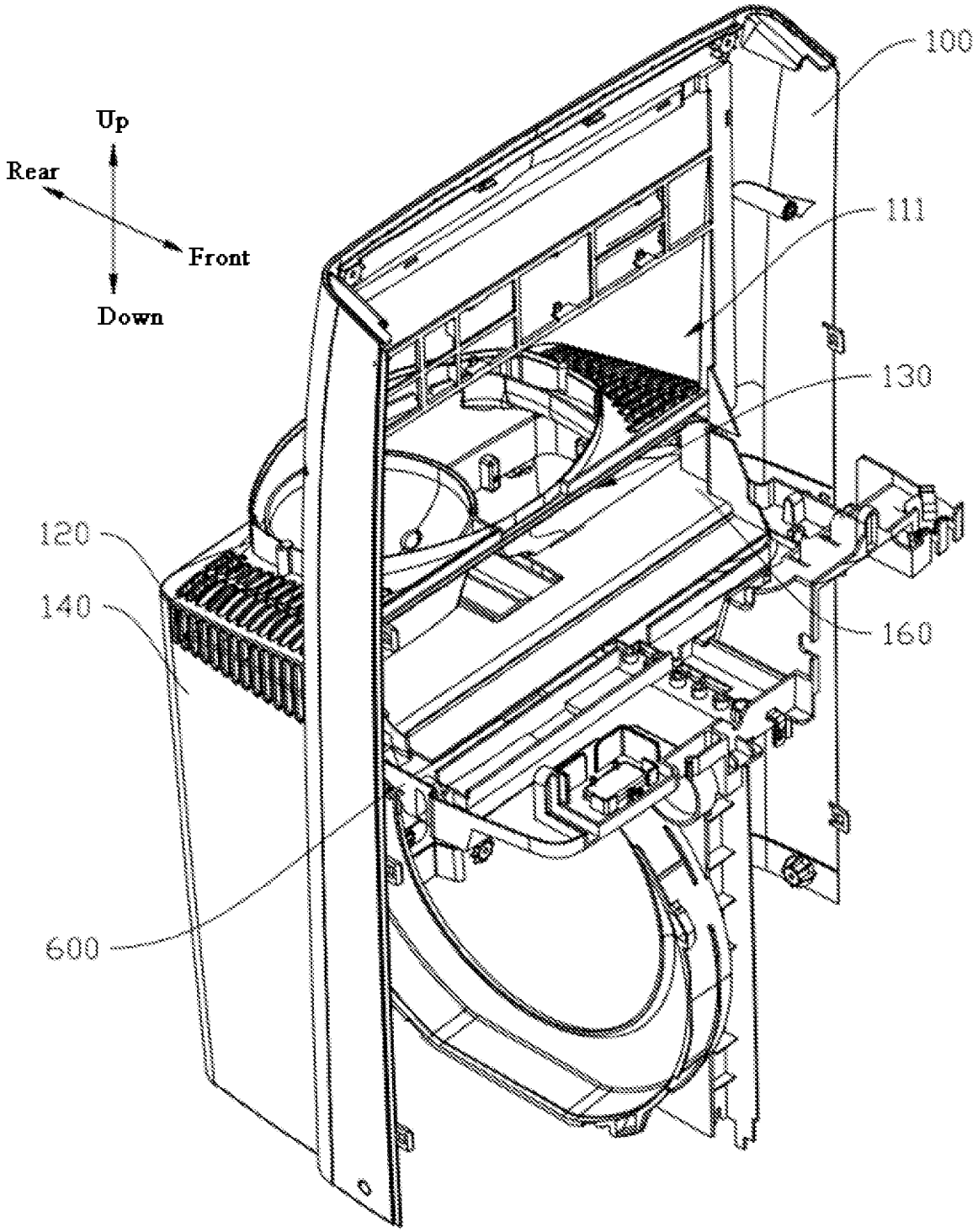
FIG. 9 is a schematic structural diagram of a cabinet and a middle plate of a portable air conditioner according to another embodiment of the present disclosure.

Referring to FIG. 4, FIG. 5 and FIG. 6, in some embodiments of the present disclosure, the portable air conditioner further includes an air deflector 700 located in the rear housing 140, and the air deflector 700 is connected to the middle plate 600 and the air duct 500 respectively in either end, so that an air intake duct for heat exchange between the portable air conditioner and an outdoor environment is isolated and sealed from the air duct 130, thereby avoiding channeling between the two ducts and influences on an air supply effect of the air supply mechanism 400. In addition, as shown in FIG. 8 and FIG. 9, an outer wall of the air deflector 700 is formed in a streamlined shape, and the air duct 130 is formed among the air deflector 700, the middle plate 600 and the rear housing 140, so that the resistance of the air duct 130 is smaller, the air intake is smoother, the heat exchange efficiency of the heat exchanger 300 is enhanced, the heat exchange efficiency of the portable air conditioner is improved, and air intake noise is effectively reduced.

Referring to FIG. 1 and FIG. 2, for the sake of overall structural aesthetics, the air duct 500 is generally mounted at an upper end of the rear housing 140 and located at a rear end of the back plate 110, which may block the first air inlet 111 on the back plate 110 to some extent, thereby affecting the air intake of the air outlet housing 200. Therefore, by arranging the vent holes 120 at an interval along a periphery of the air duct 500, the air intake volume can be further increased near the first air inlet 111, and the intake air volume of the air outlet housing 200 can be effectively increased, thereby improving the heat exchange efficiency of the portable air conditioner. Moreover, the layout of the vent holes 120 is more compact, which makes the structure of the portable air conditioner more compact. In addition, the vent holes 120 may be arranged on a wall surface of the rear housing 140 in a left-right direction. It may be understood that the vent holes 120 may be arranged on a left side wall surface, a right side wall surface or both left and right side wall surfaces of the rear housing 140. The vent holes 120 are arranged on the side wall, so that the influence of the air duct 500 on the vent holes 120 can be reduced, and an air supply effect of the vent holes 120 can be ensured.

With reference to FIG. 2, in order to further improve the air intake effect, a plurality of vent holes 120 may be provided, and the plurality of vent holes 120 are distributed on the rear wall surface and upper wall surface or other side walls of the rear housing 140, thereby further improving the air supply effect and the heat exchange effect of the portable air conditioner.

With reference to FIG. 2, in one embodiment of the present disclosure, a dimension of the vent hole 120 in a width direction is d, and d meets the conditions that: $d \geq 20$ mm. It should be noted that the dimension d of the vent hole 120 in the width direction refers to a minimum diameter or a length of a shorter side of the vent hole 120. When the above dimension is met, the air intake resistance of the vent hole 120 is less and the air intake is smoother, and the vent hole 120 can facilitate a user to clean a structure inside the vent hole 120.

With reference to FIG. 2, in another embodiment of the present disclosure, a dimension d of the vent hole 120 in a width direction satisfies that: $0 < d \leq 8$ mm. When the above dimension is met, the vent hole 120 can prevent foreign matters from falling into the cabinet 100 via the vent hole 120 and damage to the operation of the portable air conditioner, and thus facilitate cleaning the side wall of the rear housing 140.

Figure 7:
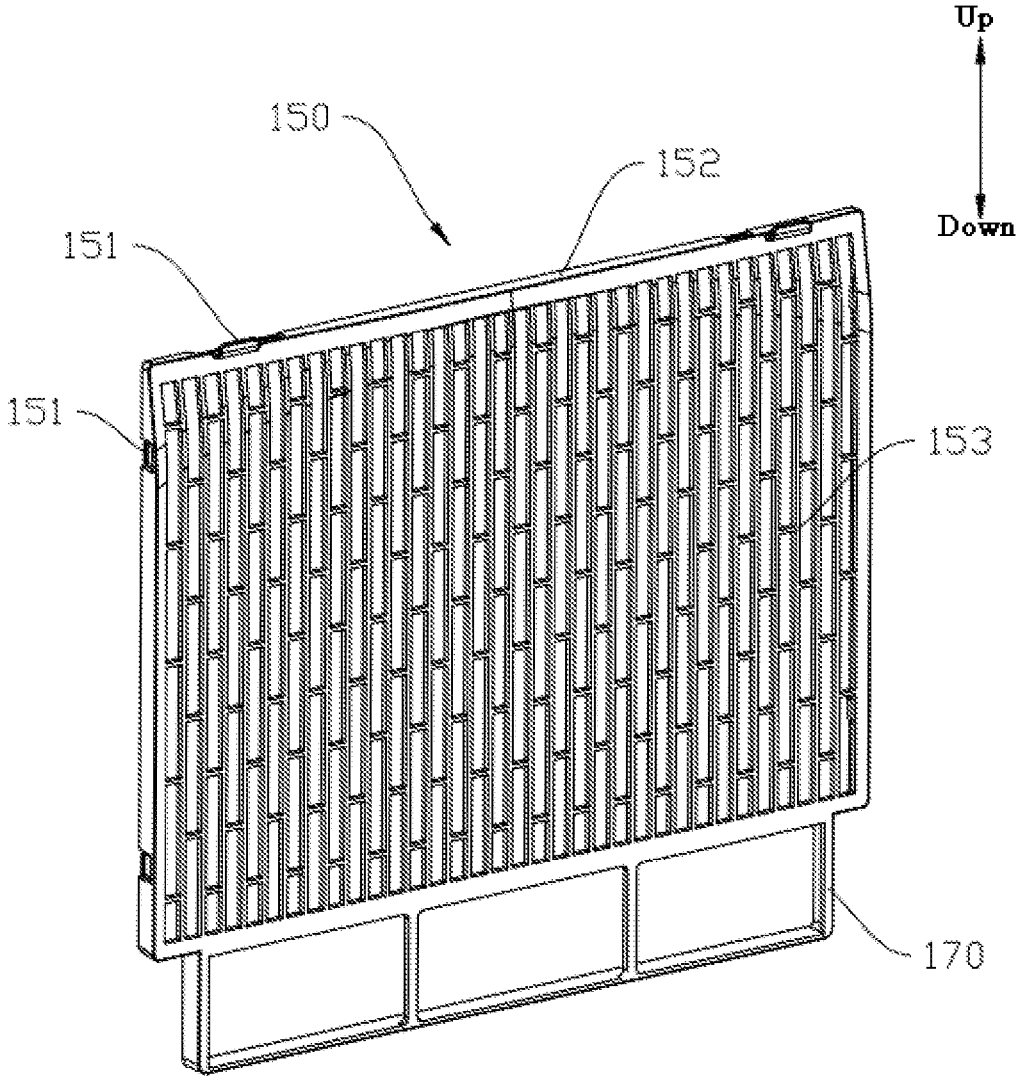
FIG. 7 is a schematic diagram of a first filter assembly and a second filter assembly in FIG. 5.

Referring to FIG. 7 and FIG. 8, in some embodiments of the present disclosure, the first air inlet 111 is detachably connected to a first filter assembly 150, and the first filter assembly 150 is connected to the back plate 110 through a buckle 151. A plurality of buckles 151 may be provided and the plurality of buckles 151 are arranged along a circumferential direction of the first filter assembly 150. To facilitate the insertion of the first filter assembly 150, installed from up to down, a lower end of the first filter assembly 150 is not provided with a buckle 151 generally. The first filter assembly 150 may also be mounted on the back plate 110 in other ways convenient for demounting, such as bolts. It should be noted that the first filter assembly 150 covers the first air inlet 111, filters the air entering the first air inlet 111, prevents the air from polluting the heat exchanger 300, and improves quality of the air blown by the air supply mechanism 400. Thus, the user experience can be improved.

Referring to FIG. 4 and FIG. 9, in some embodiments of the present disclosure, a second air inlet 160 located in the air duct 130 is further formed in the cabinet 100. The second air inlet 160 is formed between the middle plate 600 and the rear housing 140, and the second air inlet 160 is located below the first air inlet 111. In order to prevent the air intake flow of the vent hole 120 from polluting a surface of the heat exchanger 300, a second filter assembly 170 is also arranged at the second air inlet 160, and the second filter assembly 170 filters the air intake flow of the vent hole 120, thereby preventing the heat exchanger 300 from being polluted by the supplemented intake air and improving the quality of the air blown by the air supply mechanism 400. Thus, the user experience can be improved.

Referring to FIG. 5 and FIG. 8, in some embodiments of the present disclosure, the second filter assembly 170 is fixedly connected to the first filter assembly 150, and a user can disassemble the second filter assembly 170 and the first filter assembly 150 at the same time, and the second filter assembly 170 can be pulled up through the first air inlet 111 like the first filter assembly 150, so that the user can disassemble and clean the second filter assembly 170 more conveniently. It may be understood that the second filter assembly 170 and the first filter assembly 150 may be constructed as an integrated piece, and the second filter assembly 170 is formed by extending the first filter assembly 150 downwardly, which can also facilitate the user to disassemble the first filter assembly 150 and the second filter assembly 170 at the same time.

Referring to FIG. 7, in some embodiments of the present disclosure, the first filter assembly 150 includes a mounting frame 152 and a filter screen, and the mounting frame 152 is provided with a structure detachably connected to the cabinet 100, such as a buckle 151. The mounting frame 152 is also formed with a groove for accommodating a filter screen, and the filter screen may be fixed in the groove. The filter screen may also be fixed on the mounting frame 152 by bonding, screwing, or the like, which is not specifically limited here. It should be noted that a surface of the mounting frame 152 is provided with a grid 153, and the air enters the filter screen through the grid 153 for filtration. The filtered air subsequently enters the heat exchanger 300 for heat exchange, which can effectively block dust and other particles in the air and prevent impurities from accumulating on the surface of the heat exchanger 300, thereby affecting the heat exchange efficiency of the heat exchanger 300.

Referring to FIG. 5 and FIG. 6, in some embodiments of the present disclosure, the middle plate 600 is provided with a positioning frame 610, the positioning frame 610 is located in the cabinet 100 and the positioning frame 610 is located at the second air inlet 160 for positioning the second filter assembly 170. Furthermore, the positioning frame 610 is further provided with a guide part 611, the guide part is 611 is used for guiding the air duct 130 to the second air inlet 160, so that the supplemented air intake flow passing through the air duct 130 is filtered by the second filter assembly 170, thereby ensuring cleanliness of the supplemented air intake flow when entering the heat exchanger 300. In some cases of this embodiment, the positioning frame 610 is provided with a positioning groove 612 matched with the second filter assembly 170, and the second filter assembly 170 is mounted in the positioning groove 612, so that the mounting is more stable; moreover, the positioning groove 612 has a certain guiding function, which is convenient for the second filter assembly 170 to slide and disassemble, thereby improving the user experience.

Figure 10:
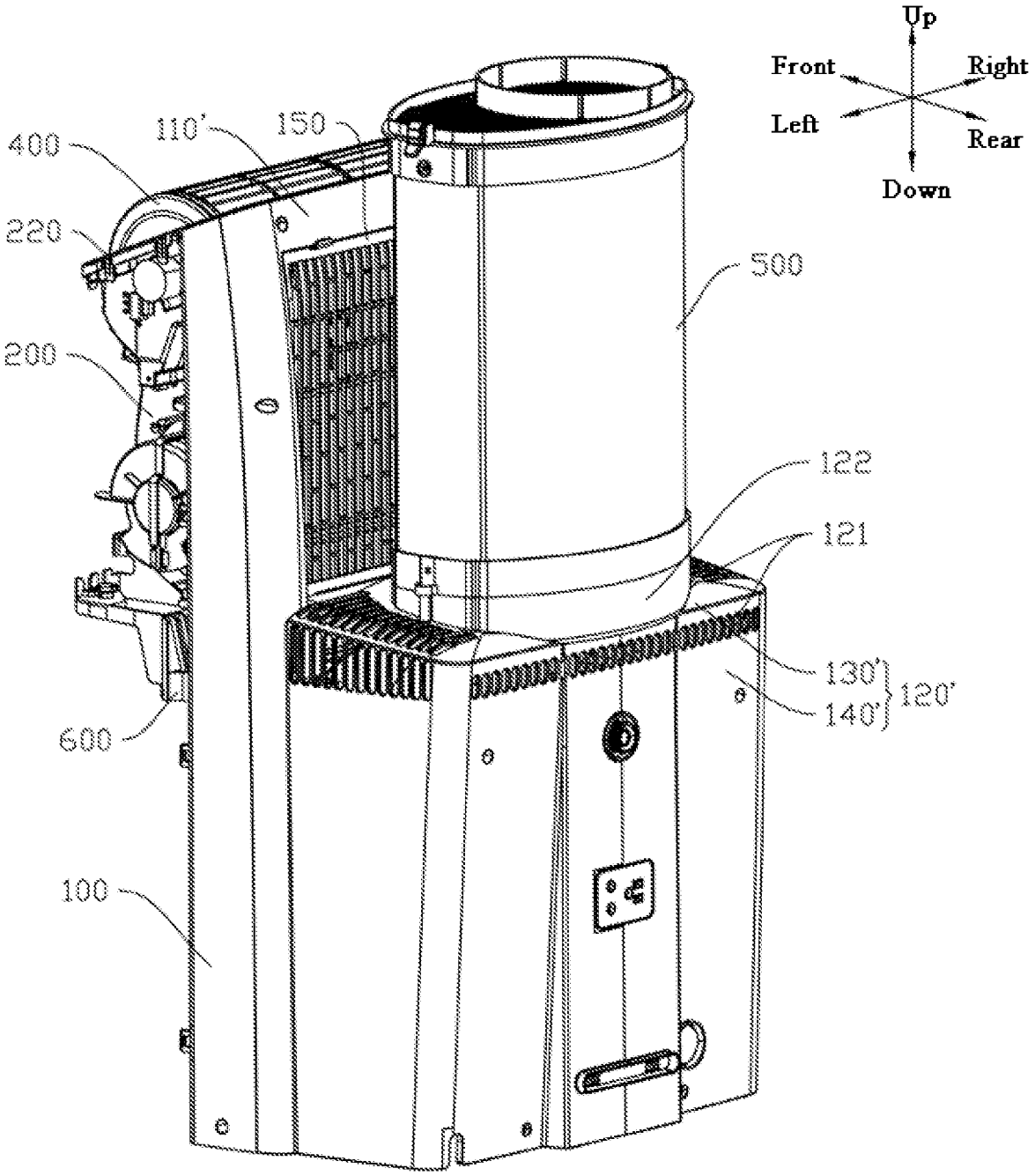
FIG. 10 is a schematic diagram of a portable air conditioner according to another embodiment of the present disclosure.
Figure 13:
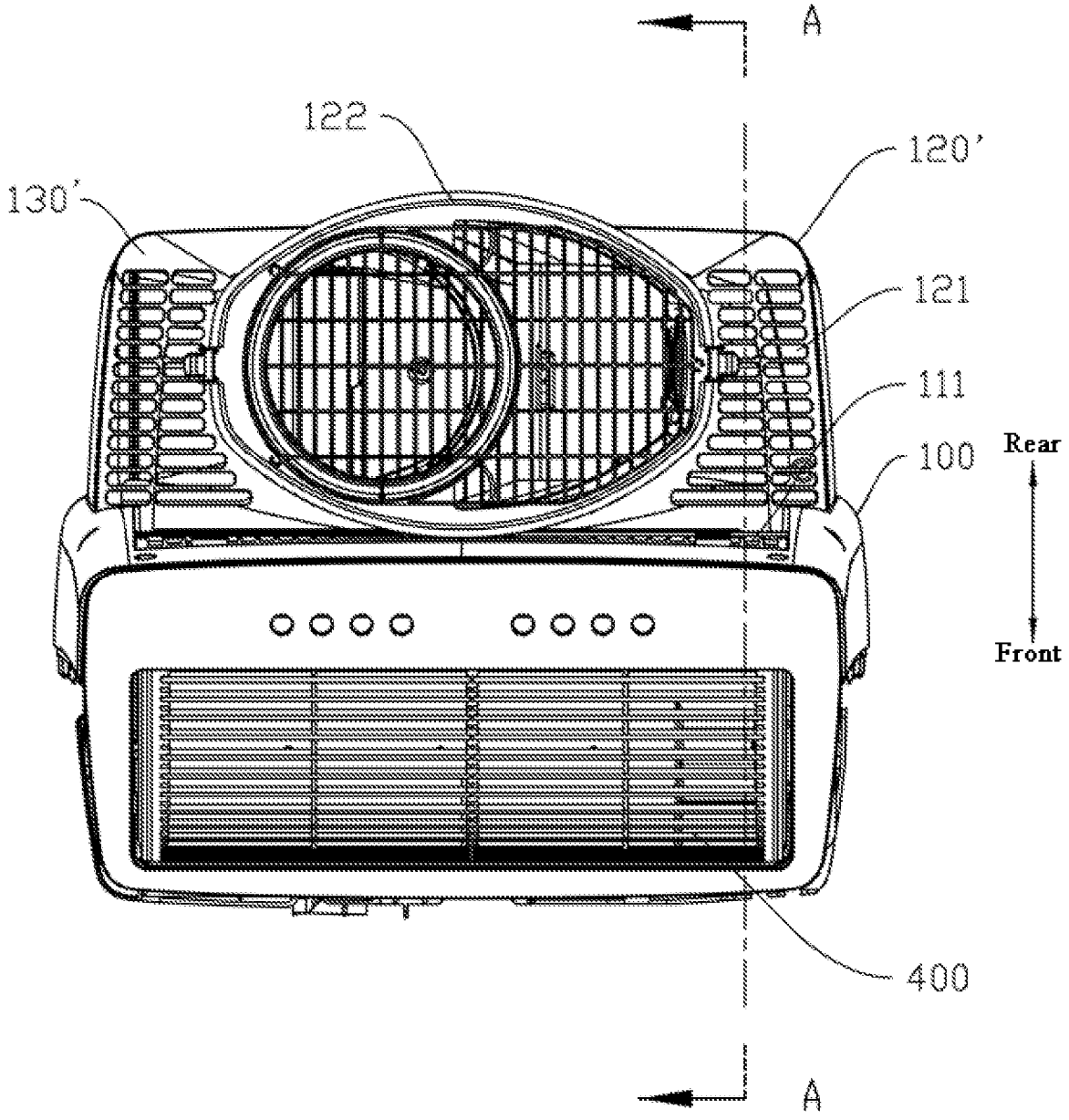
FIG. 13 is a top view of FIG. 10.
Figure 14:
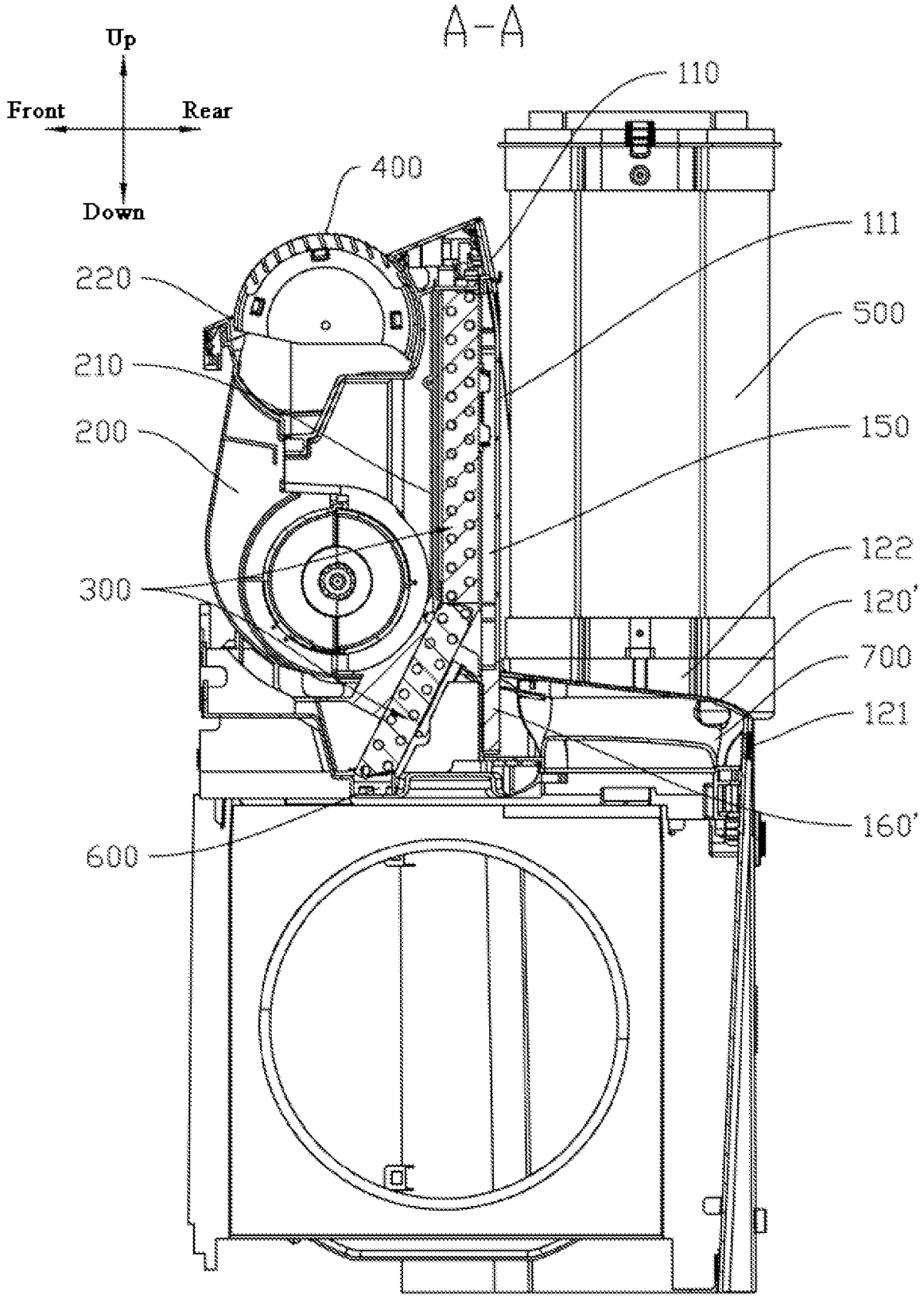
FIG. 14 is a sectional view from a section A-A in FIG. 13.

Referring to FIG. 10, FIG. 13 and FIG. 14, a portable air conditioner according to one embodiment of the present disclosure includes a cabinet 100 and an air outlet housing 200. The air outlet housing 200 is mounted in the cabinet 100, and the air outlet housing 200 is provided with an air intake hole 210 and an air outlet hole 220. A heat exchanger 300 is mounted at the air intake hole 210, and the air outlet housing 200 is mounted with an air supply mechanism 400 at the air outlet hole 220. A wind wheel is mounted in the air outlet housing 200. The wind wheel drives air in an indoor environment to pass through the heat exchanger 300. The heat exchanger 300 exchanges heat with the air to cool or heat the air. The air after heat exchange enters the air outlet housing 200 and is blown out to the indoor environment by the air supply mechanism 400, so as to adjust a temperature of the indoor environment.

Figure 12:
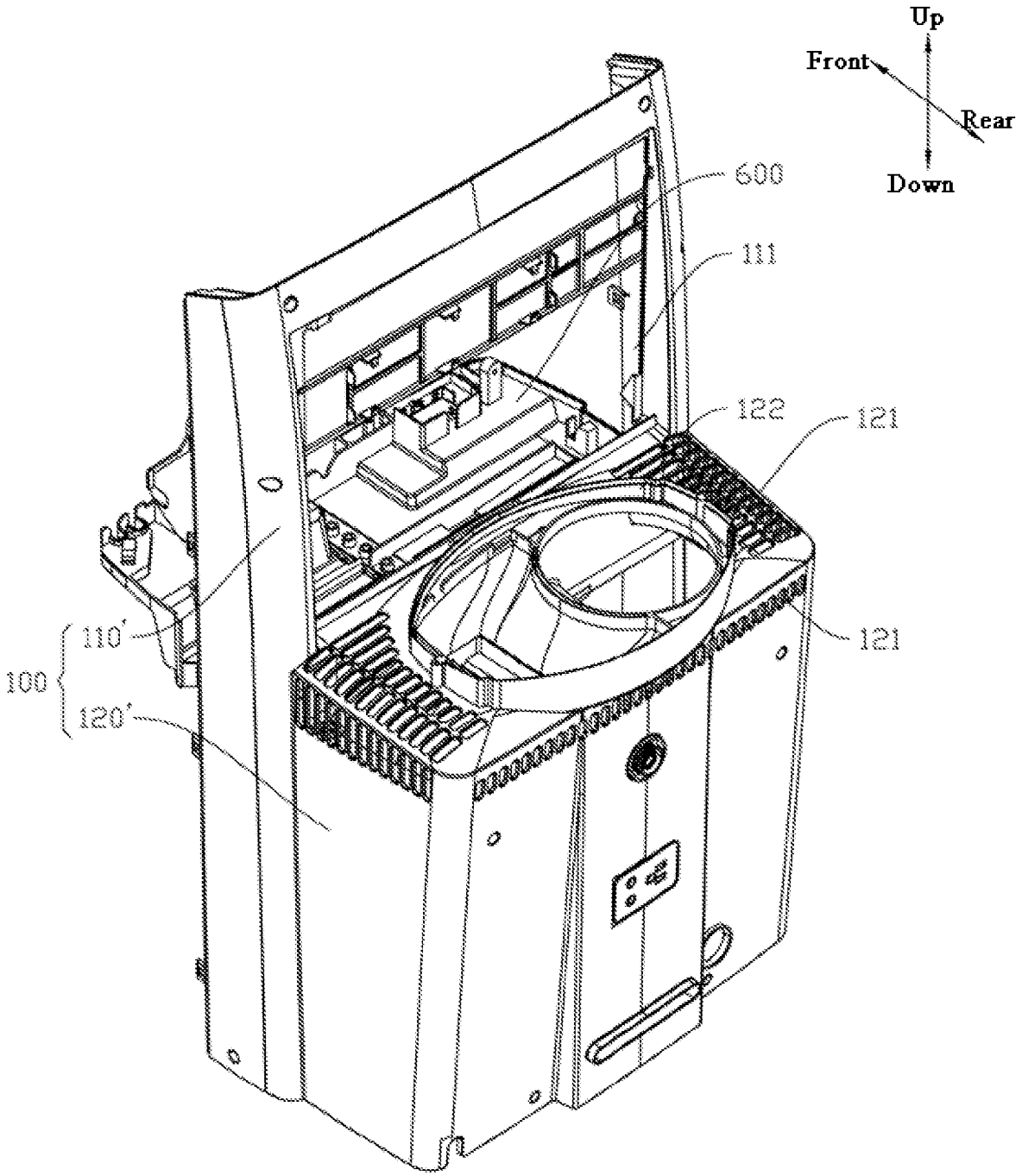
FIG. 12 is a schematic structural diagram of a cabinet and a middle plate of a portable air conditioner according to one embodiment of the present disclosure.

Referring to FIG. 10 and FIG. 12, the cabinet 100 includes an upper housing 110'. The upper housing 110' is provided with a first air inlet 111, and the first air inlet 111 is communicated with an external environment. The first air inlet 111 is a main air inlet of the portable air conditioner, and is used for air in the external environment to enter the heat exchanger 300 for heat exchange. When the portable air conditioner is running for refrigeration, a wind wheel in the air outlet housing 200 rotates, driving the air to enter the cabinet 100 from the first air inlet 111, and exchanging heat through the heat exchanger 300. The air after heat exchange is blown out from the air supply mechanism 400 under the guidance of the wind wheel to adjust a temperature of the external environment.

Figure 11:
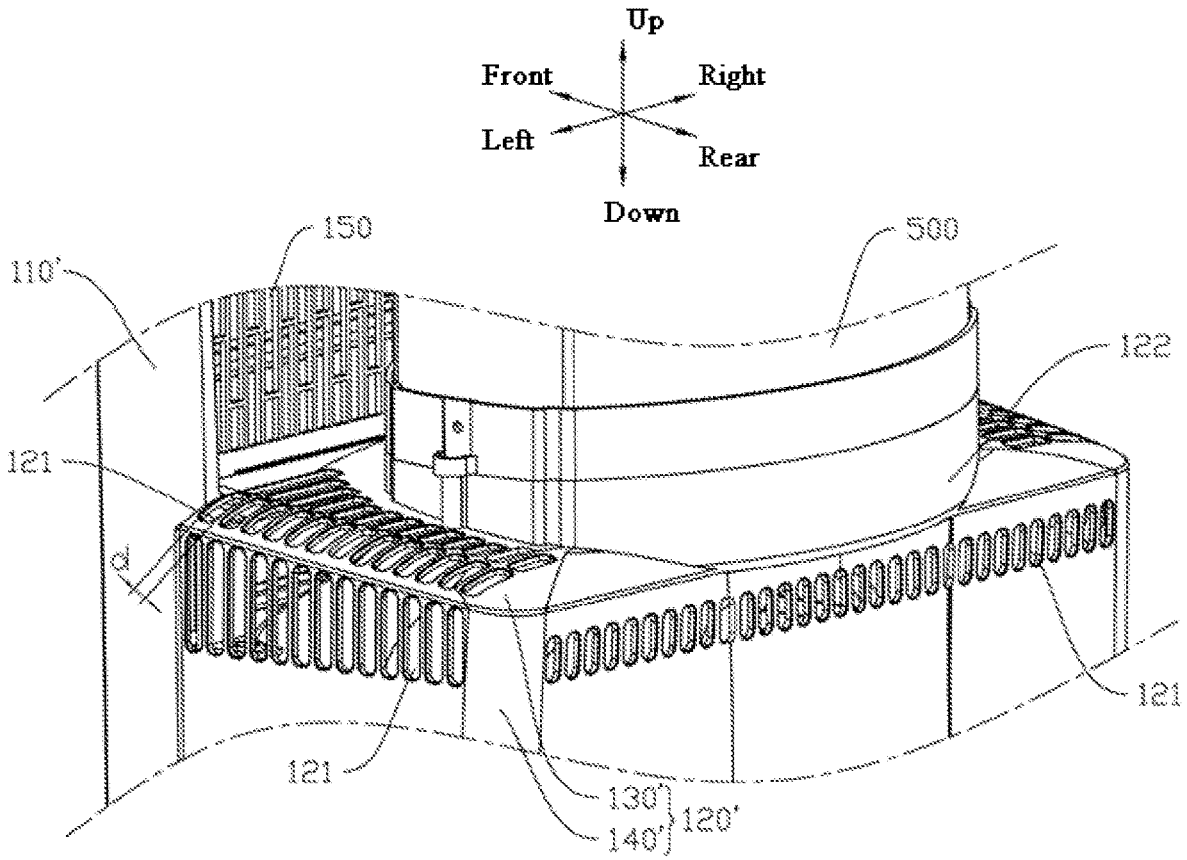
FIG. 11 is a partial enlarged view of FIG. 10.

Referring to FIG. 10, FIG. 11 and FIG. 12, a portable air conditioner according to one embodiment of the present disclosure has a cabinet 100 provided with a lower housing 120'. The lower housing 120' and the upper housing 110' may be manufactured by an integrated molding method, such as integrated injection molding. The lower housing 120' is arranged by protruding backwardly relative to the upper housing 110', and an upper part of the lower housing 120' is provided with a mounting part 122 for fixing the air duct 500. Because a mounting position of the air duct 500 of the portable air conditioner in this embodiment is fixed behind the first air inlet 111, the air duct 500 will block a part of the first air inlet 111, thereby influencing an air intake volume of the portable air conditioner. In order to increase the intake air volume of the portable air conditioner, the lower housing 120' is provided with a second air inlet 121. It may be understood that the second air inlet 121 is located below the first air inlet 111 and arranged separately. The second air inlet 121 is communicated with the external environment, and may be used as an auxiliary air inlet of the portable air conditioner. The second air inlet 121 is communicated with the heat exchanger 300, and a second air intake channel is formed, which serves as a supplemented air intake channel of the air outlet housing 200, and is used for supplying supplemented air from the external environment into the heat exchanger 300 for heat exchange. The second air inlet 121 and the mounting part 122 are staggered, so that the air duct formed by the connection between the mounting part 122 and the air duct 500 and the second air intake channel are isolated from each other, thereby preventing channeling to affect the heat exchange efficiency.

As shown in FIG. 13 and FIG. 14, the supplemented air volume from the second air inlet 121 is guided into the air outlet housing 200 through the second air intake channel, so that the heat exchange efficiency of the heat exchanger 300 is enhanced, the heat exchange effect of the portable air conditioner is improved, and the air supply volume of the air supply mechanism 400 is increased, which improves the user experience. Moreover, when the portable air conditioner is mounted against a wall, because the first air inlet 111 is blocked by a wall surface or the air duct 500, an effective air inlet area is smaller and an air inlet volume is less. In this case, the second air inlet 121 plays a role in supplementing the air volume, which improves the capacity and the actual heat exchange effect of the portable air conditioner.

It may be understood that the second air intake channel is defined between the internal structures of the cabinet 100, and the second air intake channel may be arranged in such a way that each second air inlet 121 is independently provided with one second air intake channel, or the plurality of second air inlets 121 share one second air intake channel, which is not specifically limited here.

Referring to FIG. 12 and FIG. 14, in some embodiments of the present disclosure, the portable air conditioner further includes a middle plate 600. The middle plate 600 is arranged in the cabinet 100, and a cavity for containing the air outlet housing 200 is formed between the middle plate 600 and the cabinet 100. The air outlet housing 200 is mounted on the middle plate 600, and the second air inlet 121 is located above the middle plate 600. A second air intake channel communicating the second air inlet 121 with the heat exchanger 300 is defined between the middle plate 600 and the lower housing 120', so that the second air intake channel has good sealing performance, and the air flow of the second air inlet 121 can be prevented from blowing in the cabinet 100, thereby reducing the air intake volume loss of the second air intake channel. In addition, the second air inlet 121 introduces the supplemented air intake flow into the air outlet housing 200 through the sealed second air intake channel, thereby improving the heat exchange efficiency of the portable air conditioner.

Figure 15:
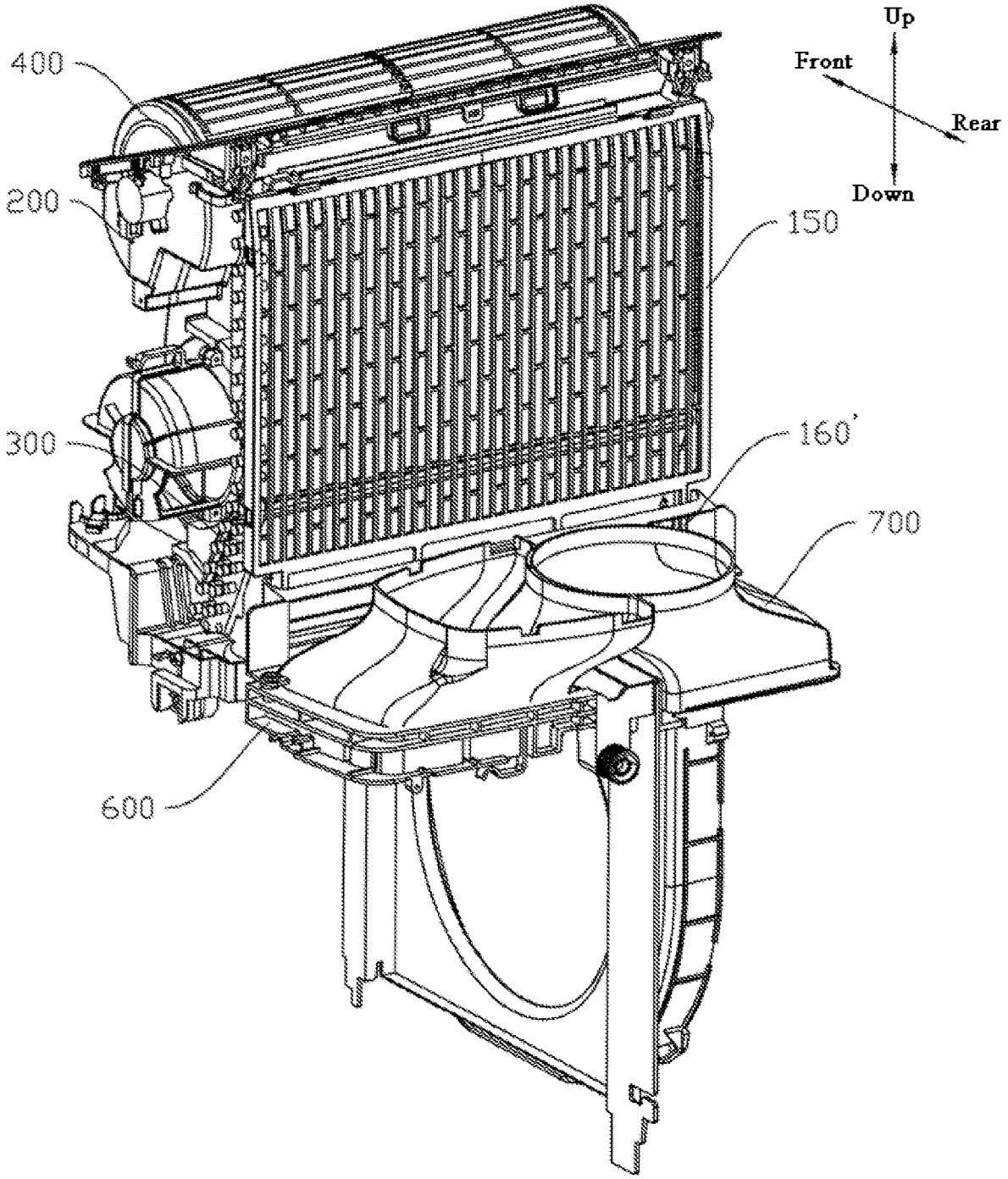
FIG. 15 is a schematic diagram of a portable air conditioner according to one embodiment of the present disclosure, with a cabinet and an air duct disassembled.

Referring to FIG. 14 and FIG. 15, in some embodiments of the present disclosure, the portable air conditioner further includes an air deflector 700. The air deflector 700 is located in the lower housing 120', and the air deflector 700 is connected to the middle plate 600 and the mounting part on the lower housing 120' used for mounting the air duct 500 respectively in either end, so that an air intake duct for heat exchange between the portable air conditioner and an outdoor environment is isolated and sealed from the second air intake channel, thereby avoiding channeling between the two ducts that affects an air supply effect of the air supply mechanism 400. In addition, as shown in FIG. 15, an outer wall of the air deflector 700 is formed in a streamlined shape, and the second air intake channel is formed among the air deflector 700, the middle plate 600 and the lower housing 120', so that the resistance of the second air intake channel is less, the air intake is smoother, the heat exchange efficiency of the heat exchanger 300 is enhanced, the heat exchange efficiency of the portable air conditioner is improved, and air intake noises can be effectively reduced, making the portable air conditioner run more stably and silently.

Referring to FIG. 10 and FIG. 11, the lower housing 120' includes a top wall 130' and a surrounding wall 140', and the surrounding wall 140' is arranged around a left end, a rear end and a right end of the top wall 130'. It may be understood that the second air inlet 121 is located in the surrounding wall 140', that is, the second air inlet 121 may be arranged on a left side wall surface, a right side wall surface, or both left and right side wall surfaces or a rear side wall surface of the surrounding wall 140', or all the wall surfaces of the surrounding wall 140'. The second air inlet 121 is arranged on the surrounding wall 140', which can reduce the influence of the air duct 500 on the second air inlet 121 and ensure the supplemented air volume effect of the second air inlet 121.

As shown in FIG. 11, the second air inlet 121 includes a plurality of through holes arranged in a uniform arrangement, and shapes of the through holes are not particularly limited, as long as an aperture size needed by the air intake is met. The plurality of through holes can increase the supplemented air volume and improve the heat exchange effect of the portable air conditioner. In one embodiment, the second air inlet 121 includes one or more elongated holes, and the elongated holes may extend in a horizontal direction or in a vertical direction, which is not specifically limited here. The plurality of elongated holes are uniformly arranged on the surrounding wall 140', or arranged on the surrounding wall 140' in an array, which is not specifically limited here. In addition, the second air inlet 121 includes a plurality of circular holes or polygonal holes which are uniformly arranged on the surrounding wall 140'.

It may be understood that, in order to further increase the air intake effect, the air duct 500 is generally mounted on a top wall 130', which may block the first air inlet 111 of the upper housing 110' to a certain extent, thereby affecting the air intake of the air outlet housing 200. Therefore, by arranging the second air inlet 121 on the top wall 130' and along a periphery of the mounting part 122, the air intake volume can be further increased near the first air inlet 111, the air intake volume of the air outlet housing 200 can be effectively increased, and channeling with the air duct 500 can be avoided, which improves the heat exchange efficiency of the portable air conditioner.

With reference to FIG. 11, in one embodiment of the present disclosure, a dimension of the second air inlet 121 provided on the top wall 130' needs to meet certain requirements, for example, a diameter of a largest inscribed circle inside the second air inlet 121 is d, and d meets the conditions that: $0<d\leq 8$ mm. It should be noted that, in the solution of this embodiments of the present disclosure, the diameter of the largest inscribed circle inside the second air inlet 121 is d, and here, the largest inscribed circle may be understood as the largest inscribed circle that can be formed by an outer contour track of each through hole corresponding to the second air inlet 121.

For example, when the second air inlet 121 is an elongated hole, d refers to a length of the shorter side of the elongated hole; when the second air inlet 121 is a circular hole, d refers to a diameter of the circular hole. When d meets the above parameter requirements, foreign matters can be prevented from falling into the cabinet 100 from the second air inlet 121 and damage to the operation of the portable air conditioner, thereby facilitating the cleaning of the lower cabinet 120' and meeting the requirements of safety regulations.

Figure 16:
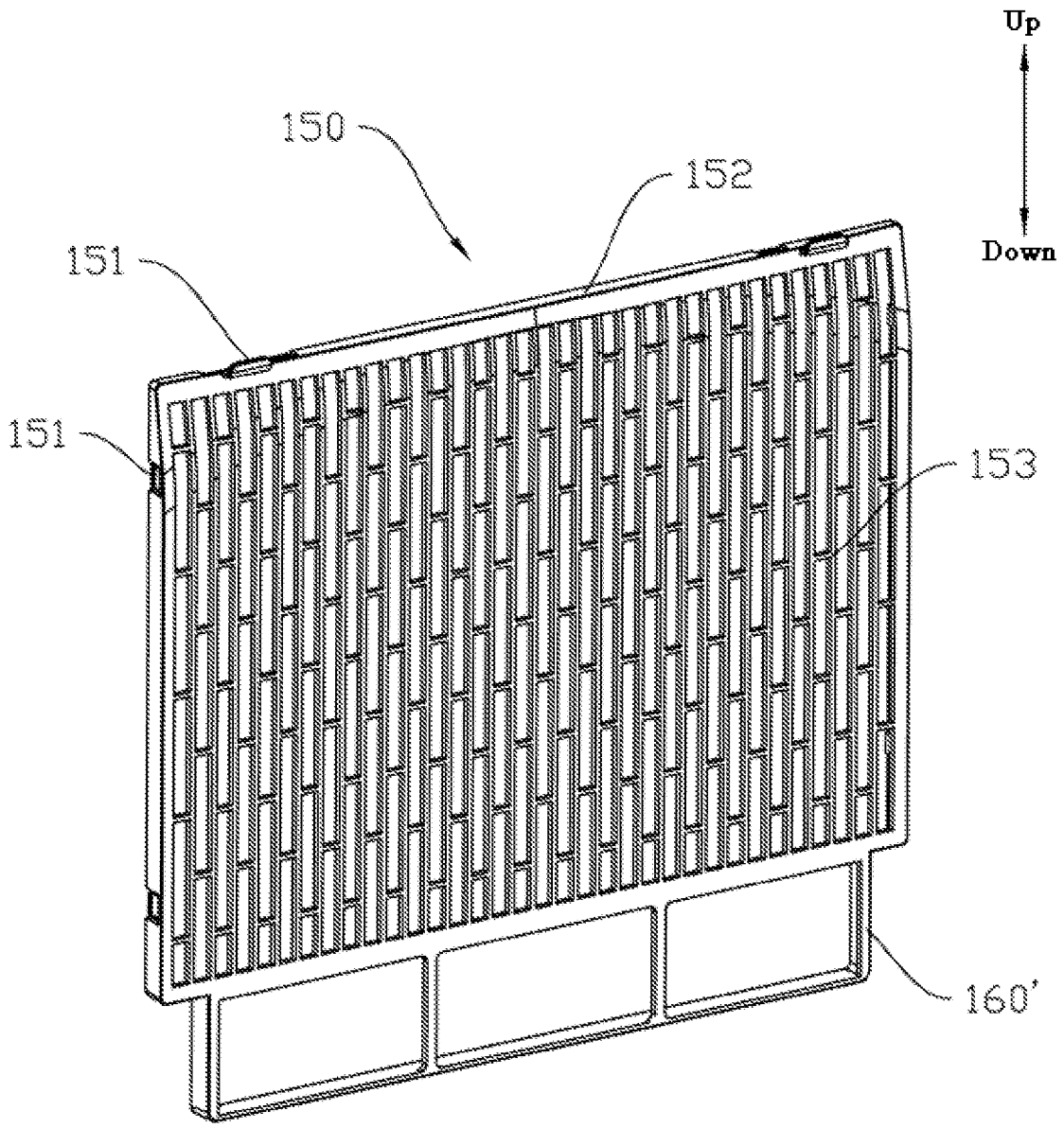
FIG. 16 is a schematic diagram of a first filter assembly and a second filter assembly in FIG. 15.

Referring to FIG. 15 and FIG. 16, in some embodiments of the present disclosure, the first air inlet 11 is detachably connected to a first filter assembly 150, and the first filter assembly 150 is connected to the upper housing 110' through the buckle 151. A plurality of buckles 151 may be provided, and the plurality of buckles 151 are arranged along a circumferential direction of the first filter assembly 150. The first filter assembly 150 may also be mounted on the upper housing 110' in other convenient ways, such as bolts. It should be noted that the first filter assembly 150 covers the first air inlet 111, filters the air entering the first air inlet 111, prevents the air from polluting the heat exchanger 300, and improves the quality of the air blown by the air supply mechanism 400. Thus, the user experience is improved.

Referring to FIG. 14 and FIG. 15, in some embodiments of the present disclosure, in order to prevent a surface of the heat exchanger 300 from being polluted by an air intake flow of the second air inlet 121, a second filter assembly 160' is arranged in the lower housing 120'. The second filter assembly 160' is located in the second air intake channel, and the second filter assembly 160' filters the air intake flow of the second air inlet 121 to prevent the heat exchanger 300 from being polluted by supplemented intake air. Moreover, the quality of the air blown out by the air supply mechanism 400 can also be improved, and the user experience is improved.

Referring to FIG. 15 and FIG. 16, in some embodiments of the present disclosure, the second filter assembly 160' is fixedly connected to the first filter assembly 150, and a user can disassemble the second filter assembly 160' and the first filter assembly 150 at the same time, and the second filter assembly 160' can be pulled up through the first air inlet 111 like the first filter assembly 150, so that the second filter assembly 160' is more convenient to disassemble and clean by the user. To facilitate the insertion of the first filter assembly 150 and the second filter assembly 160', installed or removed together from up to down, a lower end of the first filter assembly 150 is not provided with a buckle 151 which is matched with the upper housing 110' generally. It may be understood that the second filter assembly 160' and the first filter assembly 150 may be constructed as an integrated piece, for example, by integrated injection molding. The second filter assembly 160' is formed by extending the first filter assembly 150 downwardly, which can also facilitate the user to disassemble the first filter assembly 150 and the second filter assembly 160' at the same time.

In one embodiment, referring to FIG. 16, in some embodiments of the present disclosure, the first filter assembly 150 includes a mounting frame 152 and a filter screen, and the mounting frame 152 is provided with a structure detachably connected to the cabinet 100, such as a buckle 151, which is convenient for disassembling and cleaning, and more convenient for the user to operate. The mounting frame 152 is also formed with a groove for accommodating a filter screen, and the filter screen may be fixed in the groove. The filter screen may also be fixed on the mounting frame 152 by bonding, screwing, or the like, which is not specifically limited here. It should be noted that a surface of the mounting frame 152 is provided with grids 153, and grid holes are formed between the grids 153. Before the air enters the first air intake channel in the upper housing 110' through the grid holes on the mounting frame 152, the air needs to be filtered by the filter screen, and then the filtered air enters the heat exchanger 300 for heat exchange, which can effectively block dust and other particles in the air and prevent impurities from accumulating on the surface of the heat exchanger 300, thereby improving the heat exchange efficiency of the heat exchanger 300.

The exemplary embodiments of the present disclosure have been described in detail above with reference to the drawings, but the present disclosure is not limited to the above embodiments, and various changes can be made without departing from the purpose of the present disclosure within the scope of knowledge possessed by those of ordinary skills in the art.

What claimed is:

1. A portable air conditioner comprising:

a cabinet comprising an upper housing and a rear housing, wherein the upper housing is provided with a first air inlet; and the rear housing extends from a rear of the upper housing below the first air inlet, and the rear housing is provided with a second air inlet; and an air outlet housing mounted in the cabinet, wherein a heat exchanger is mounted on the air outlet housing at an air intake side, wherein:

the first air inlet is communicated with the heat exchanger and forms a first air intake channel; and the second air inlet is communicated with the heat exchanger and forms a second air intake channel.

2. The portable air conditioner according to claim 1, wherein the rear housing comprises a top wall and a surrounding wall connected to a lower end of the top wall, and the second air inlet is located on the surrounding wall.

3. The portable air conditioner according to claim 2, wherein the second air inlet comprises a plurality of uniformly arranged through holes.

4. The portable air conditioner according to claim 2, wherein the second air inlet is located on the top wall, the top wall is provided with a mounting part for fixing an air duct, and the second air inlet is arranged along a periphery of the mounting part.

5. The portable air conditioner according to claim 4, wherein a diameter of a largest inscribed circle inside the second air inlet is d, and d meets a condition that: $0<d\leq 8$ mm.

6. The portable air conditioner according to claim 1, further comprising a middle plate, wherein the middle plate is arranged in the cabinet, the second air intake channel is formed between the middle plate and the rear housing, and the second air inlet is located above the middle plate.

7. The portable air conditioner according to claim 6, further comprising an air deflector located in the rear housing, wherein an upper part of the rear housing is provided with a mounting part used for fixing an air duct, the air deflector is respectively connected to the middle plate and the mounting part in either end, and the second air intake channel is formed among the air deflector, the middle plate and the rear housing.

8. The portable air conditioner according to claim 1, wherein the first air inlet is detachably connected to a first filter assembly, and the first filter assembly is used for filtering air entering the first air inlet.

9. The portable air conditioner according to claim 8, wherein the rear housing is provided with a second filter assembly inside, and the second filter assembly is located at the second air intake channel for filtering air entering the second air inlet.

10. The portable air conditioner according to claim 9, wherein the second filter assembly and the first filter assembly are formed in an integrated piece.

* * * * *